US006824743B1

(12) United States Patent
Pawson et al.

(10) Patent No.: US 6,824,743 B1
(45) Date of Patent: Nov. 30, 2004

(54) SPACE EFFICIENT EXHAUST AFTERTREATMENT FILTER

(75) Inventors: Kenneth Pawson, Northampton (GB); William C. Haberkamp, Cookeville, TN (US)

(73) Assignee: Fleet Guard, Inc., Nashville, TN (US)

( * ) Notice: Subject to any disclaimer, the term of this patent is extended or adjusted under 35 U.S.C. 154(b) by 0 days.

(21) Appl. No.: 09/577,560

(22) Filed: May 24, 2000

(51) Int. Cl.[7] ..... F01N 3/021; F01N 3/28

(52) U.S. Cl. ..... 422/171; 422/168; 422/177; 422/181; 55/DIG. 10; 55/DIG. 30

(58) Field of Search ..... 422/168–171, 422/177, 181; 55/DIG. 10, DIG. 30; 60/311

(56) References Cited

U.S. PATENT DOCUMENTS

| | | | | |
|---|---|---|---|---|
| 3,290,121 | A | 12/1966 | Malkiewicz | 422/179 |
| 3,495,950 | A | 2/1970 | Barber et al. | 422/171 |
| 3,503,716 | A | 3/1970 | Berger | 422/170 |
| 3,607,133 | A | 9/1971 | Hirano | 55/DIG. 30 |
| 3,807,173 | A | 4/1974 | Zmuda et al. | 60/302 |
| 4,495,153 | A | 1/1985 | Midorikawa | 422/171 |
| 5,440,876 | A | 8/1995 | Bayliss et al. | 60/274 |
| 5,538,697 | A | 7/1996 | Abe et al. | 422/171 |
| 5,653,105 | A | 8/1997 | Noirot et al. | 60/297 |
| 5,656,244 | A | 8/1997 | Cole | 422/171 |
| 5,916,135 | A | 6/1999 | Yoshida et al. | 60/302 |
| 5,934,069 | A | 8/1999 | Hertl et al. | 60/274 |

FOREIGN PATENT DOCUMENTS

| | | |
|---|---|---|
| DE | 39 42 380 | 6/1991 |
| EP | 0 931 913 | 7/1999 |

OTHER PUBLICATIONS

Patent Abstracts of Japan, vol. 17, No. 700 (C–1145), Dec. 21, 1993 & JP 05 237397 A (Yamaha Motor Co., Ltd.) Sep. 17, 1993.

Patent Abstracts of Japan, vol. 1997, No. 03, Mar. 31, 1997 & JP 08 296433 A (Isuzu Motors, Ltd.), Nov. 12, 1996.

*Primary Examiner*—Hien Tran
(74) *Attorney, Agent, or Firm*—Andrus, Sceales, Starke & Sawall, LLP

(57) ABSTRACT

An exhaust aftertreatment filter (20) includes a housing (22) extending axially along an axis (28) between distally opposite first and second ends (30 and 32), a first port (34) at the first end of the housing, a second port (36) also at the first end of the housing, one of the first and second ports being an inlet, and the other being an outlet, the housing having an intermediate section (38) between the distally opposite ends, the intermediate section having a given cross sectional area A1 along a sectional plane transverse to the axis, a catalytic exhaust filter element (24) in the intermediate section and entirely filling the cross sectional area A1 except for a smaller cut-out (40) in the exhaust filter element of cross sectional area A2, the exhaust filter element having a cross sectional area A3=A1−A2, a transfer tube (26) extending through the cut-out and communicating with the second port. Exhaust flows axially (42) through the exhaust filter element between first and second distally opposite sides (44 and 46) of the exhaust filter element, the first side facing the first end of the housing, the second side facing the second end of the housing, exhaust flowing axially through the exhaust filter element in one axial direction (42) and flowing through the transfer tube and cut-out in the opposite axial direction (48).

2 Claims, 1 Drawing Sheet

SPACE EFFICIENT EXHAUST AFTERTREATMENT FILTER

BACKGROUND AND SUMMARY

The invention relates to the packaging of mufflers and exhaust components for internal combustion engines, and more particularly to an exhaust aftertreatment filter, including catalytic devices, that need to be fit into a limited space.

The invention arose during development efforts directed toward minimizing the space required for an exhaust aftertreatment filter, and maximizing the usable area of a filter or catalytic element. The invention also arose during development efforts attempting to accommodate different types of exhaust system configurations without necessitating a complete redesign of the exhaust aftertreatment filter housing. The present invention meets these and other needs in a particularly simple and effective manner.

DETAILED DESCRIPTION

Figure 1:
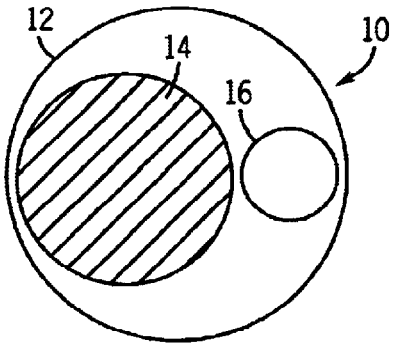
FIG. 1 is an illustration of a space inefficient exhaust aftertreatment filter.

FIG. 1 shows a space inefficient exhaust aftertreatment filter 10 including a cylindrical housing 12, an exhaust filter element 14, such as a catalytic element, and a return or transfer tube 16. This type of arrangement can be used where it is desired to have both the inlet and outlet on the same end of the filter housing, rather than opposing ends. Exhaust from the engine flows to the filter inlet then into the page in FIG. 1 through catalytic filter element 14 and then reverses direction and flows out of the page through return tube 16 to the outlet of the filter. In the example in FIG. 1, return tube 16 has a 5 inch outer diameter, and filter housing 12 has an 18 inch inner diameter, with half inch clearance. This leaves space for an 11.5 inch round substrate catalytic filter element 14 having an area of 103.9 square inches.

Figure 2:
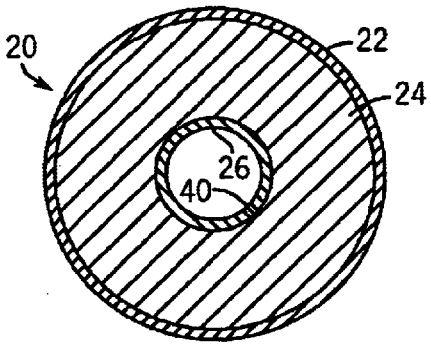
FIG. 2 is an illustration of a space efficient exhaust aftertreatment filter, and is taken along line 2—2 of FIG. 3.

FIG. 2 shows a space efficient exhaust aftertreatment filter 20 including housing 22, catalytic exhaust filter element 24, and transfer or return tube 26. Using the same dimensions as in FIG. 1, i.e. housing 22 has an 18 inch inner diameter and transfer tube 26 has a 5 inch outer diameter, the area of catalytic filter element 24 can now be increased to 198.7 square inches. This ninety-one percent increase in surface area of the catalytic filter element is attained without increasing the size of the filter housing, i.e. filter housings 22 and 12 have the same diameter, yet catalytic filter element 24 has ninety-one percent more cross sectional area than catalytic filter element 14.

Figure 3:
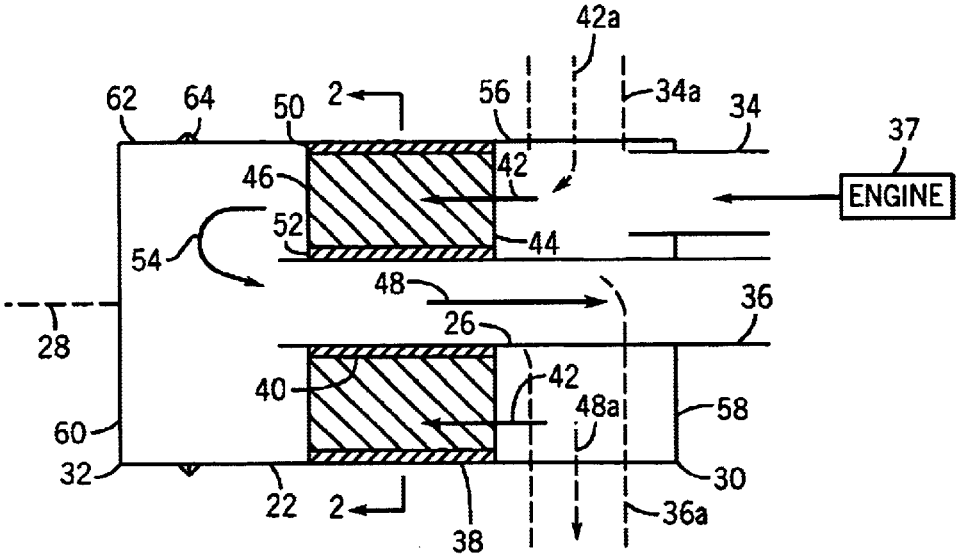
FIG. 3 is a side sectional view of an exhaust aftertreatment filter in accordance with the invention.

FIG. 3 shows housing 22 extending axially along an axis 28 between distally opposite first and second ends 30 and 32. A first port 34 is provided at first end 30 of the housing, and a second port 36 is also provided at first end 30 of the housing. One of the ports is an inlet, and the other port is an outlet. In the embodiment of FIG. 3, port 34 is the inlet receiving exhaust from engine 37, and port 36 is the outlet. Housing 22 has an intermediate section 38 between distally opposite ends 30 and 32. The intermediate section 38 has a cross sectional area A1 along sectional plane 2—2 transverse to axis 28. Exhaust filter element 24 is in intermediate section 38 and entirely fills the noted cross sectional area A1 except for a smaller cut-out 40 in exhaust filter element 24 of cross sectional area A2. Exhaust filter element 24 has a cross sectional area A3=A1−A2. Transfer or return tube 26 extends through cut-out 40 and communicates with port 36. Port 34 communicates with exhaust filter element 24. Exhaust flows axially as shown at arrows 42 through exhaust filter element 24 between first and second distally opposite sides 44 and 46 thereof. First side 44 faces first end 30 of the housing, and second side 46 faces second end 32 of the housing. Exhaust flows axially as shown at arrow 48 through transfer tube 26 through cut-out 40 in the opposite axial direction, i.e. in the orientation of FIG. 3, axial flow 42 is leftwardly, and axial flow 48 is rightwardly. The outer periphery of exhaust filter element 24 is sealed at insulative sealing material 50 to housing 22, and the inner periphery of filter element 24 at cut-out 40 is sealed at insulative sealing material 52 to transfer tube 26, such that all exhaust flow passes through exhaust filter element 24 without bypass.

First side 44 of exhaust filter element 24 communicates with first port 34. Second end 32 of housing 22 is closed, and exhaust flow reverses axial direction as shown at arrow 54 at second end 32 of the housing. Second side 46 of exhaust filter element 24 communicates through the noted flow reversal at 54 and transfer tube 26 through cut-out 40 with second port 36. Cut-out 40 is axially aligned with port 36. First side 44 of exhaust filter element 24 is axially aligned with port 34. In an alternate embodiment, first port 34 may be non-aligned with first side 44 such that the exhaust flow direction changes between first port 34 and first side 44. In another embodiment, exhaust flow between the first port and the first side of the exhaust filter element may include a radial component, relative to axis 28, at the first port, and an axial component at the first side of the exhaust filter element, to be described. Housing 22 includes a sidewall 56 extending axially between distally opposite first and second end walls 58 and 60. Both of the first and second ports 34 and 36 may extend through first end wall 58, as shown in FIG. 3. In alternate embodiments, one or both of first and second ports 34 and 36 may extend through sidewall 56 at a location between first side 44 of exhaust filter element 24 and first end wall 58, for example as shown in dashed line at 34*a* and 36*a*, respectively, providing the above noted radial flow components for example as shown in dashed line at 42*a* and 48*a*, respectively. These alternatives still enable both the inlet and the outlet to be at the same axial end of the housing. In preferred form, the first port 34 or 34*a* is the inlet, and the second port 36 or 36*a* is the outlet, such that first side 44 of exhaust filter element 24 is an upstream dirty side, and second side 46 of exhaust filter element 24 is a downstream clean side. In an alternate embodiment, the second port 36 or 36*a* is the inlet, and the first port 34 or 34*a* is the outlet, such that second side 46 of exhaust filter element 24 is an upstream dirty side, and first side 44 of exhaust filter element 24 is a downstream clean side.

In the preferred embodiment, housing 22 is cylindrical, and transfer tube 26 extends centrally axially in the housing and defines a central flow channel within transfer tube 26, and defines an annular flow channel within housing 22 and concentrically surrounding transfer tube 26 and the central flow channel therein. Catalytic exhaust filter element 24 is provided as an annular member in the noted annular flow channel and having a central cut-out 40 receiving transfer tube 26 therethrough. Exhaust both enters and exits housing 22 at first end 30 at inlet 34 or 34*a* and outlet 36 or 36*a*, respectively. Exhaust flows axially through the noted annular flow channel and exhaust filter element 24 in one axial direction such as 42, and exhaust flows axially through the noted central flow channel and transfer tube 26 and cut-out 40 in the opposite axial direction such as 48. Further in the preferred embodiment, second end 32 of housing 22 is closed by a removable cover 62 attached to housing 22 by threads, clamps, or the like, schematically shown at 64. Removal of cover 62 permits inspection and removal of exhaust filter element 24 from housing 22 without disassembling the exhaust system, for example without disassembling inlet 34 from housing 22 and without disassembling outlet 36 from housing 22.

It is recognized that various equivalents, alternatives and modifications are possible within the scope of the appended claims.

What is claimed is:

1. An exhaust aftertreatment filter comprising a housing extending axially along an axis between distally opposite first and second ends, a first port at said first end of said housing, a second port also at said first end of said housing, one of said first and second ports being an inlet, the other of said first and second ports being an outlet, said housing having an intermediate section between said distally opposite ends, said intermediate section having a given cross-sectional area A1 along a sectional plane transverse to said axis, an exhaust filter element in said intermediate section and entirely filling said given cross-sectional area A1 except for a smaller cut-out in said exhaust filter element of cross-sectional area A2, said exhaust filter element having a cross-sectional area A3=A1−A2, a transfer tube extending through said cut-out and communicating with said second port, said first port communicating with said exhaust filter element, wherein exhaust flows axially through said exhaust filter element between first and second distally opposite sides of said exhaust filter element, said first side facing said first end of said housing, said second side facing said second end of said housing, wherein exhaust flows axially through said exhaust filter element in one axial direction, wherein exhaust flows axially through said transfer tube through said cut-out in the opposite axial direction, wherein:

said first side of said exhaust filter element communicates with said first port;

said second end of said housing is closed, and exhaust flow reverses axial direction at said second end of said housing;

said second side of said exhaust filter element communicates through said flow reversal and said transfer tube through said cut-out with said second port;

said second end of said housing is closed by a removable cover permitting inspection and removal of said exhaust filter element from said housing without disassembling said inlet from said housing and without disassembling said outlet from said housing.

2. An exhaust aftertreatment filter comprising a housing extending axially along an axis between distally opposite first and second ends, a first port at said first end of said housing, a second port also at said first end of said housing, one of said first and second ports being an inlet, the other of said first and second ports being an outlet, said second end of said housing being closed, a transfer tube extending axially in said housing and defining a central flow channel within said transfer tube, and defining an annular flow channel within said housing and concentrically surrounding said transfer tube and said central flow channel therein, an annular exhaust filter element in said annular flow channel, said annular exhaust filter element having a central cut-out receiving said transfer tube therethrough, wherein exhaust both enters and exits said housing at said first end at said inlet and said outlet, respectively, and wherein exhaust flows axially through said annular flow channel and said exhaust filter element in one axial direction, and wherein exhaust flows axially through said central flow channel and said transfer tube and said cut-out in the opposite axial direction, wherein exhaust flows axially in said annular flow channel through said exhaust filter element between first and second distally opposite sides of said exhaust filter element, said first side facing said first end of said housing having both of said first and second ports, said second side facing said second closed end of said housing, said exhaust flow reversing axial direction at said second closed end of said housing, said second end of said housing is closed by a removable cover permitting inspection and removal of said exhaust filter element from said housing without disassembling said inlet from said housing and without disassembling said outlet from said housing.

* * * * *